US012234646B2

(12) United States Patent
Aitken

(10) Patent No.: US 12,234,646 B2
(45) Date of Patent: Feb. 25, 2025

(54) BUILDING TRUSS, SYSTEM, AND CONSTRUCTION METHOD

(71) Applicant: TRUSSED SYSTEMS LIMITED, Waihi Beach (NZ)

(72) Inventor: Kim Elizabeth Aitken, Hunstville (CA)

(73) Assignee: Trussed Systems Limited, Waihi Beach (NZ)

( * ) Notice: Subject to any disclaimer, the term of this patent is extended or adjusted under 35 U.S.C. 154(b) by 0 days.

(21) Appl. No.: 17/602,012

(22) PCT Filed: Apr. 11, 2019

(86) PCT No.: PCT/CA2019/050441
§ 371 (c)(1),
(2) Date: Oct. 7, 2021

(87) PCT Pub. No.: WO2020/206526
PCT Pub. Date: Oct. 15, 2020

(65) Prior Publication Data

US 2022/0145632 A1 May 12, 2022

(51) Int. Cl.
*E04C 3/42* (2006.01)
*E04B 1/34* (2006.01)
(Continued)

(52) U.S. Cl.
CPC ..... *E04C 3/42* (2013.01); *E04B 1/3408* (2013.01); *E04C 3/16* (2013.01); *E04C 3/17* (2013.01)

(58) Field of Classification Search
CPC ..... E04C 3/42; E04C 3/16; E04C 3/17; E04B 1/3408; E04B 5/12; E04B 1/18; E04B 1/26; E04B 2001/268; E04B 1/3527
See application file for complete search history.

(56) References Cited

U.S. PATENT DOCUMENTS 1,885,330 A * 11/1932 Cherdron ..... E04B 2/60 52/639
4,005,556 A * 2/1977 Tuomi ..... E04B 1/26 52/93.2

(Continued)

FOREIGN PATENT DOCUMENTS

FR 2417603 A1 9/1979

OTHER PUBLICATIONS

International Search Report issued in PCT/CA2019/050441; mailed Jan. 2, 2020.

*Primary Examiner* — Lee A Holly
(74) *Attorney, Agent, or Firm* — Studebaker & Brackett PC

(57) ABSTRACT

A building truss including a structural floor element, a vertical support on each side of the structural floor element, rafters spanning the vertical supports, a structural horizontal tie which interconnects the rafters, and a roof peak on the horizontal tie. A building is constructed by erecting multiple trusses parallel to each other in sequence in a longitudinal direction spanning one gable end to the opposed gable end. Each building truss defines the full room and roof spaces and provides the required structural strength. Each truss defines a 2D envelope; the floor element spanning in the horizontal direction, vertical supports for the vertical direction, and a roof assembly joining the two vertical supports. Each truss is unitary and constructing the multiple trusses parallel to each other provides a 3D structural building envelope.

12 Claims, 19 Drawing Sheets

(51) Int. Cl.
*E04C 3/16* (2006.01)
*E04C 3/17* (2006.01)

(56) References Cited

U.S. PATENT DOCUMENTS

| | | | | |
|---|---|---|---|---|
| 4,073,103 | A | 2/1978 | McClure | |
| 4,437,273 | A * | 3/1984 | Helfman | E04C 3/42 52/93.2 |
| 4,570,409 | A * | 2/1986 | Wilks | E02D 27/10 52/169.8 |
| 8,844,209 | B1 * | 9/2014 | Oliver | E04B 1/34347 52/157 |
| 2007/0151196 | A1 | 7/2007 | Boatwright | |
| 2007/0212172 | A1 * | 9/2007 | Brown | E02D 27/01 405/229 |
| 2007/0227095 | A1 * | 10/2007 | Hubbe | E04B 2/707 52/653.1 |
| 2017/0030072 | A1 * | 2/2017 | Corson | E04D 13/1625 |

* cited by examiner

BUILDING TRUSS, SYSTEM, AND CONSTRUCTION METHOD

INTRODUCTION

The invention relates to construction of buildings such as residential houses.

It is known to provide a roof truss and to construct a building by combining the roof frame with a vertical structure, typically a wall of masonry which may be in two leaves with a cavity. It is also known to adjoin a roof frame to a wood frame structure.

The present invention is directed towards providing more efficient construction of buildings, with shorter lead times from site preparation to finish, and enhanced accuracy of interconnection of structural elements.

SUMMARY OF THE INVENTION

We describe a prefabricated building truss comprising:

(a) a roof truss assembly including at least one rafter and at least one joist;

(b) at least two opposed building room-height vertical supports which are bridged by the roof truss assembly at roof level; and (c) a horizontal structural floor element extending between and connected to the vertical supports at floor level, the structural floor element being configured to engage a building foundation.

Preferably, at least one vertical support comprises a plurality of laterally spaced-apart vertical struts, and at least one diagonal brace between the vertical struts.

Preferably, a lower first diagonal brace joins the struts at floor level, and at least one upper diagonal brace joins the struts above the first brace.

Preferably, wherein the structural floor element comprises a top beam, a bottom beam, and internal support structural members between said beams.

Preferably, the floor structural members comprise a series of uprights and diagonal braces.

Preferably, the vertical support first diagonal brace is laterally offset of the structural floor element, providing a continuation of bracing support across the truss at floor level.

Preferably, the roof truss assembly is integrated with the vertical supports by a rafter engaging at least one vertical strut of each opposed vertical support.

Preferably, each vertical support comprises at least two vertical struts in which outer struts are lower in height than inner struts, and the roof truss assembly rafters span the vertical support struts, thereby providing additional bracing strength to the vertical supports and also integrating the roof truss assembly with the vertical supports to form an envelope together with the structural floor.

Preferably, the roof truss assembly comprises a structural horizontal roof tie which comprises the at least one joist, and interconnects opposed rafters of the roof truss assembly, and said rafters are connected to the vertical supports.

Preferably, the roof truss assembly comprises at least one brace, parallel to a rafter, and connecting a vertical support to the horizontal tie.

Preferably, the horizontal tie comprises at least two parallel horizontal tie members and a support structure between the horizontal tie members.

Preferably, the horizontal tie support structure comprises a plurality of load-bearing braces joining the horizontal tie members.

Preferably, the truss comprises a peak roof truss, which is attachable to underlying components of the roof truss assembly, said peak truss and the rafters adapted to combine to form an apex roof structure.

Preferably, the roof truss assembly comprises a structural horizontal roof tie which comprises the at least one joist, and interconnects opposed rafters of the roof truss assembly, and wherein the peak truss is attachable to the horizontal tie.

We also describe a building system or kit comprising a plurality of prefabricated building trusses of any previous embodiment, and further comprising a foundation system, truss interconnect beams for interconnecting the trusses when placed parallel to each other in series in the longitudinal direction, and panels for interconnecting the trusses in the longitudinal direction to form wall, floor and ceiling surfaces, wherein the truss structural floor elements together with the floor panels form a structural floor configured to engage the foundation system.

Preferably, the foundation system comprises a plurality of foundation points extending from the structural floor. Preferably, the foundation system comprises a foundation beam spanning a plurality of the foundation points. Preferably, each foundation point comprises a bearing for connection to the foundation beam, at a first end of the bearing.

Preferably, the bearing is adapted to be connected at a second end to a nailer, which is connected to a steel base plate, which is connected to a steel auger plate, the auger plate being configured to be pinned or torqued into bedrock.

We also describe a building comprising a system of any embodiment in which the building trusses are erected parallel to each other in series in the longitudinal direction, are joined by the interconnect beams and the panels in the longitudinal direction, and the structural floor elements combine to form a structural floor mounted on the foundation system.

We also describe a method of constructing a building using a system of any embodiment including the steps of:

(a) providing the foundation system at ground level;

(b) mounting a plurality of building trusses in parallel and spaced apart in the longitudinal direction, (c) linking the trusses by interconnect beams to form a structural floor which engages the foundation system;

(d) applying the panels to form at least internal wall, floor and ceiling surfaces; and (e) providing utility services and performing finishing tasks.

Preferably, the trusses are connected to the foundation system by a foundation beam spanning a plurality of foundation points.

Preferably, the trusses are erected on the foundation beams in sequence.

We also describe a method of extending a building of any embodiment, the method including the steps of:

(a) inserting building lifter beams underneath the building structural floor;

(b) lifting, using the lifter beams, the building from the structural floor up, leaving the building foundations in place;

(c) assembling a new structural floor on top of the foundations;

(d) assembling on top of the new structural floor, vertical struts for new ground floor walls, thereby forming a space at ground floor of the extended building; and (e) placing the lifted original building onto the new ground floor walls, with the original structural floor forming a ground floor ceiling structure.

Preferably, new foundation beams are installed over the foundation points, before step (c).

DETAILED DESCRIPTION OF THE INVENTION

The invention will be more clearly understood from the following description of some embodiments thereof, given by way of example only with reference to the accompanying drawings in which.

Figure 6B:
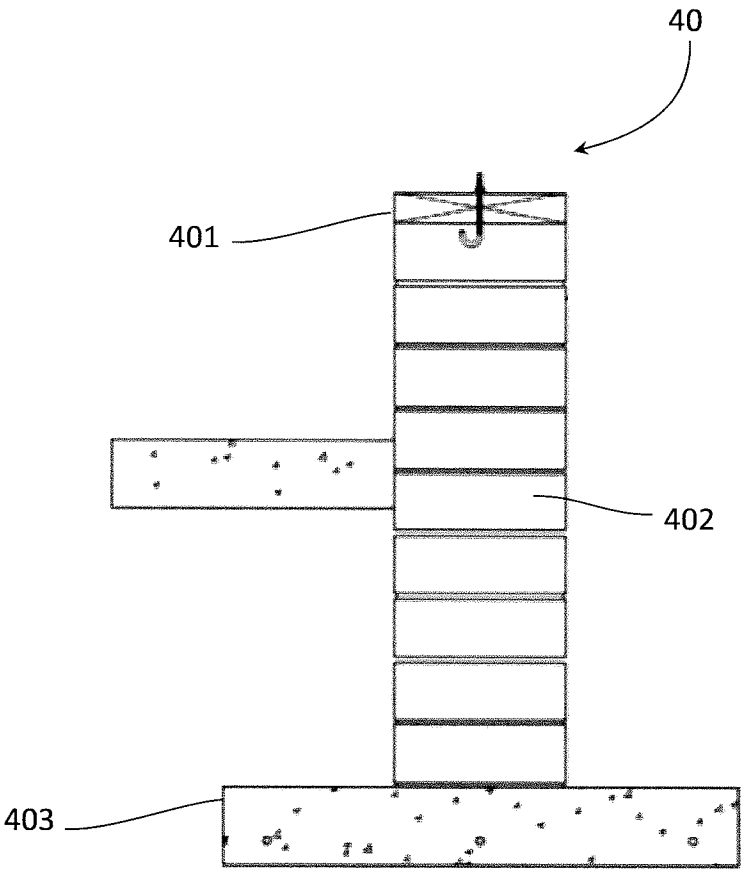
Figure 6A:
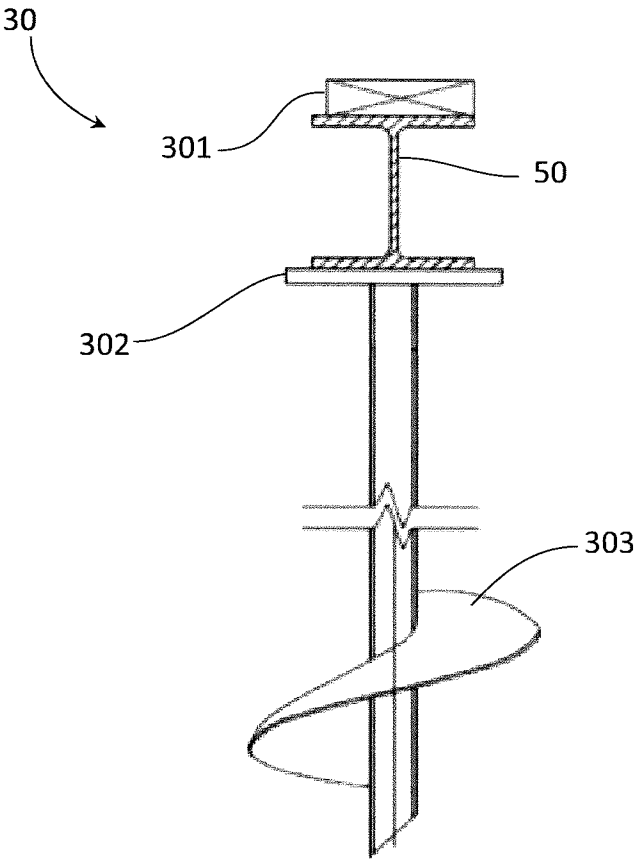
Figure 7:
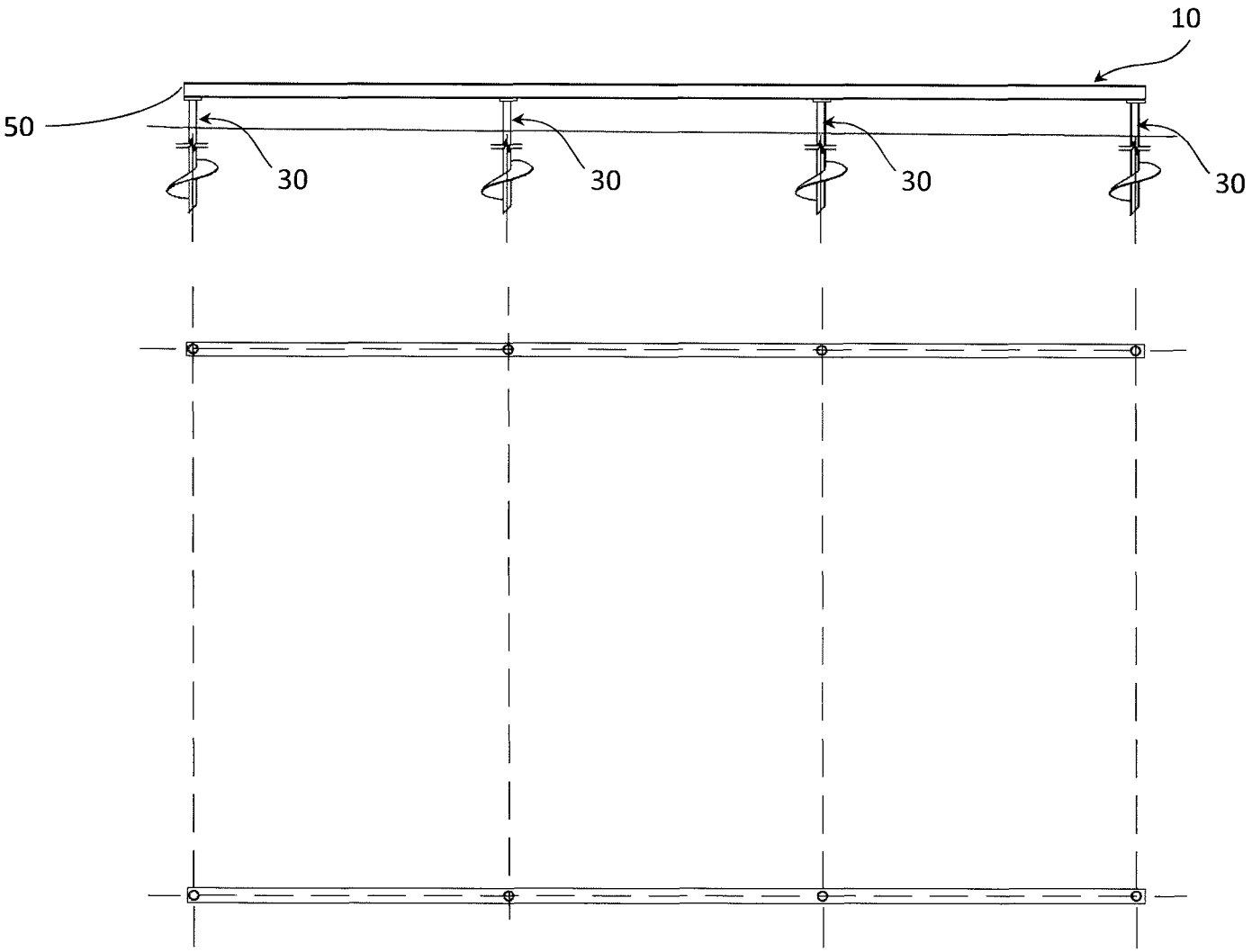
Figure 8:
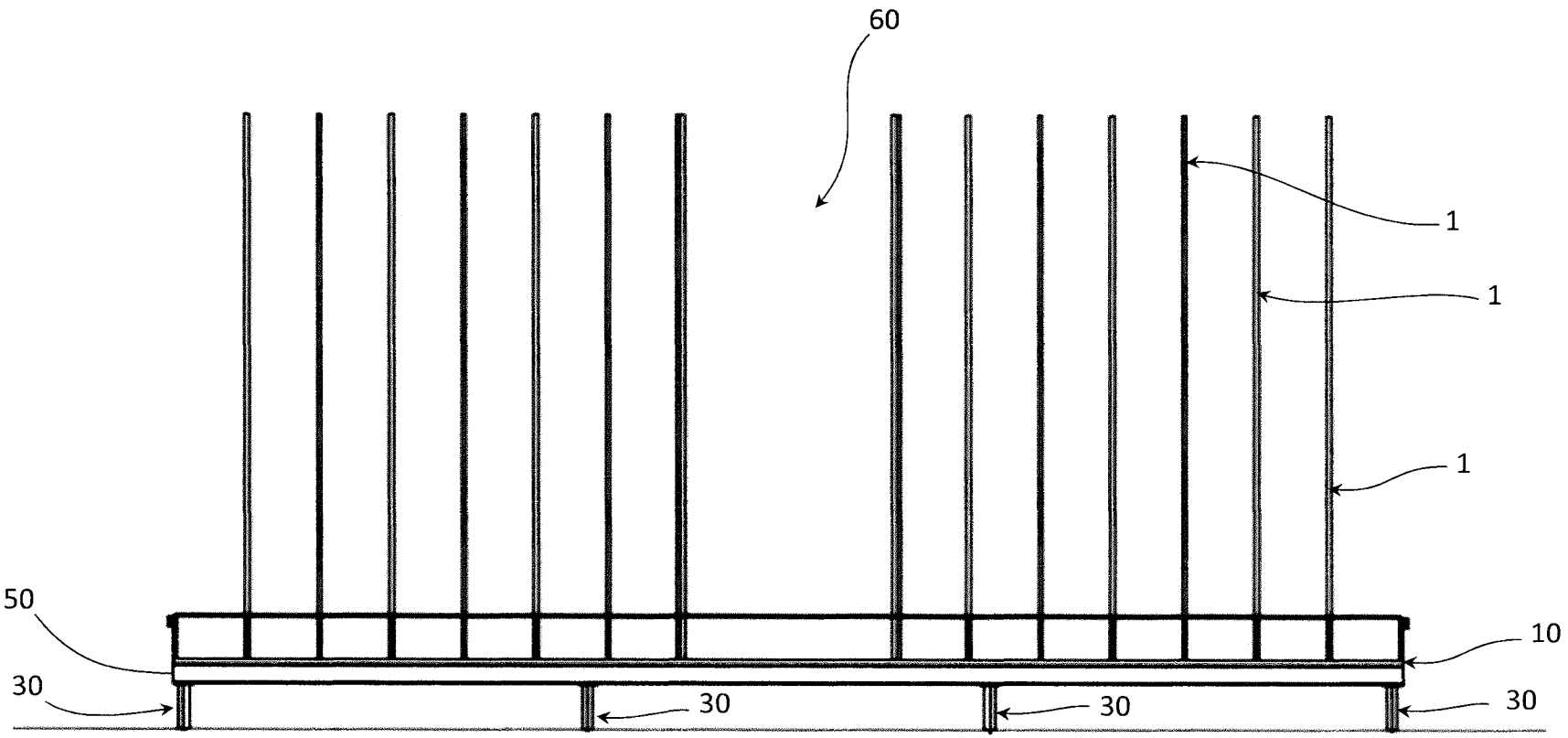
Figure 9:
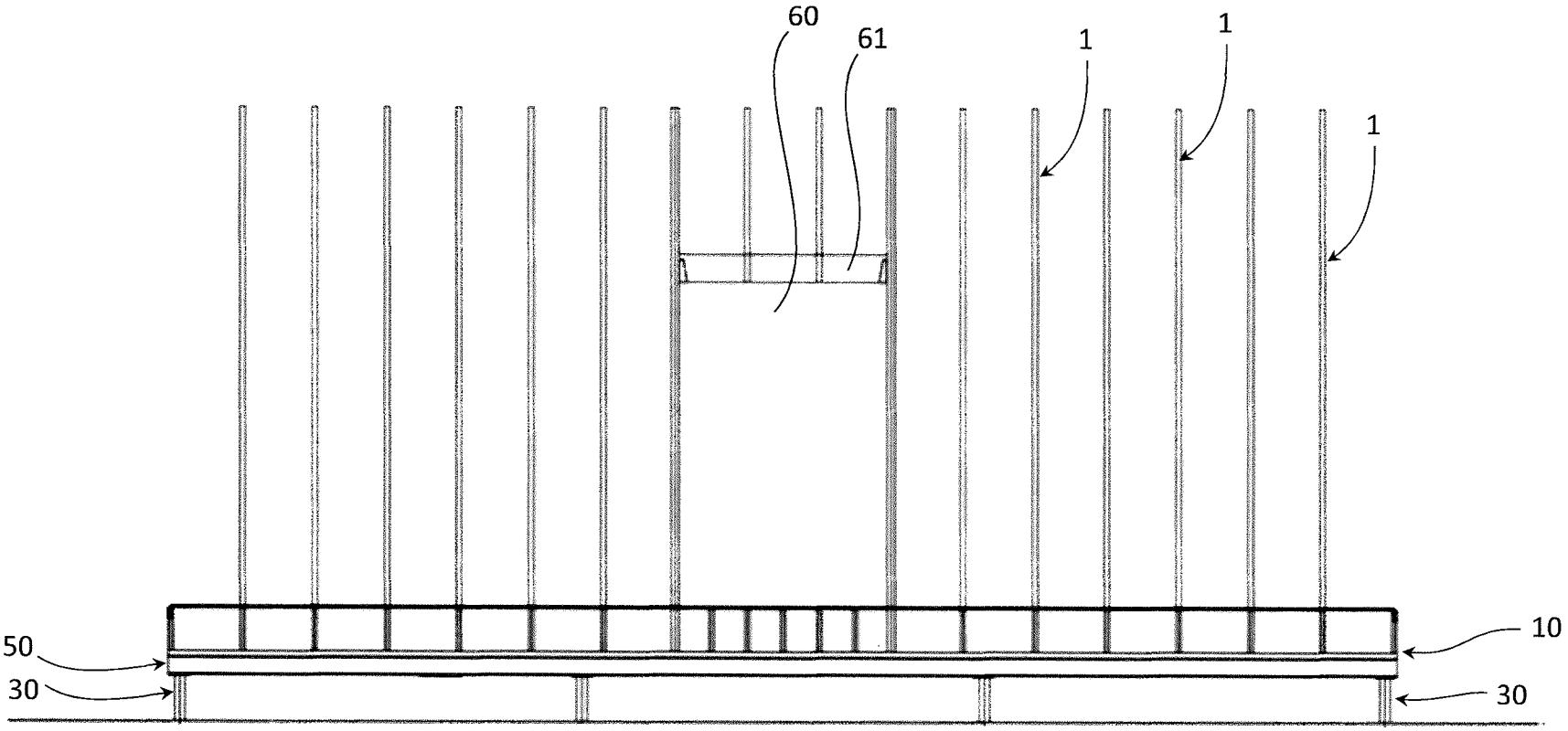
Figure 10:
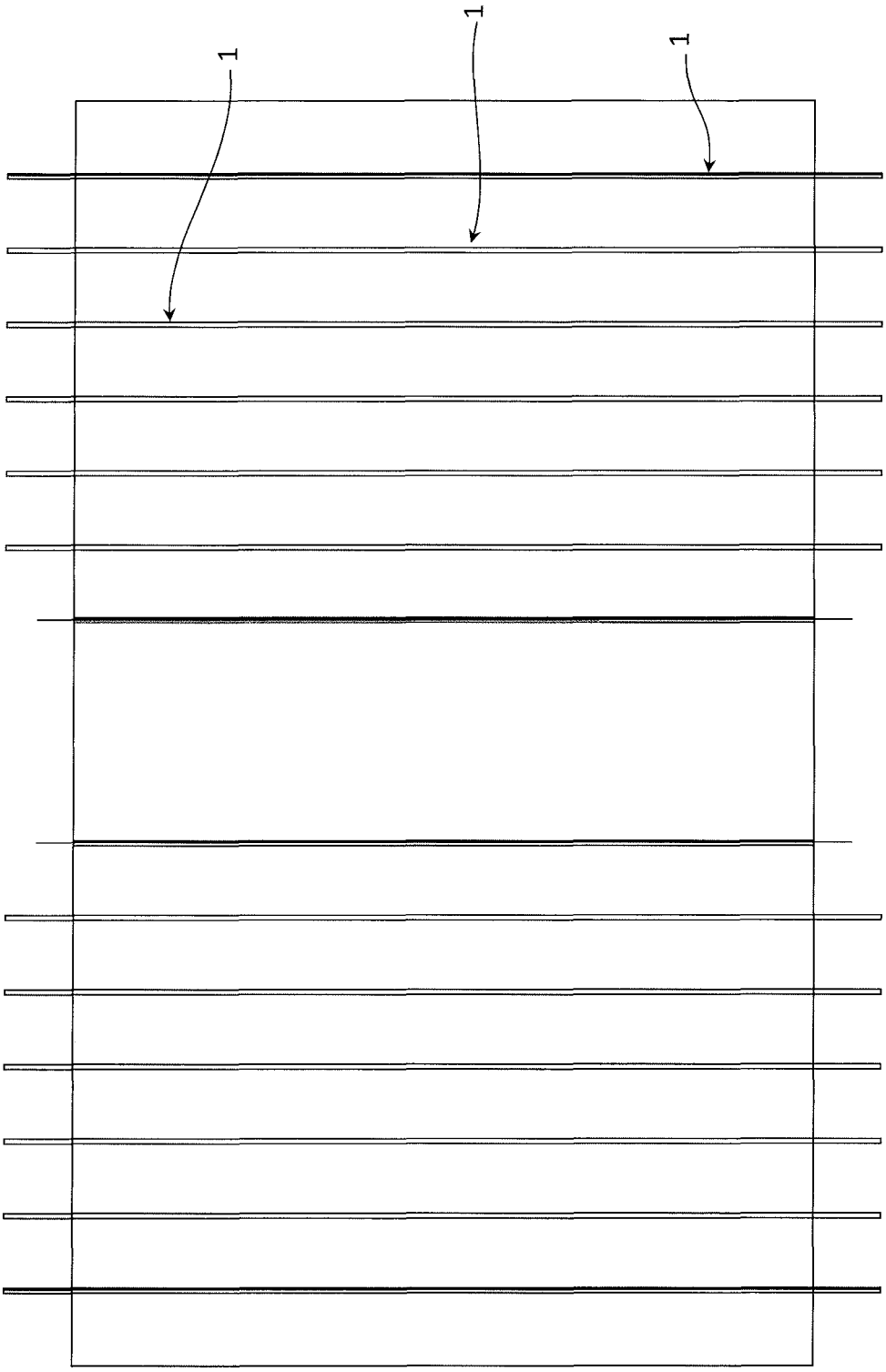
Figure 11:
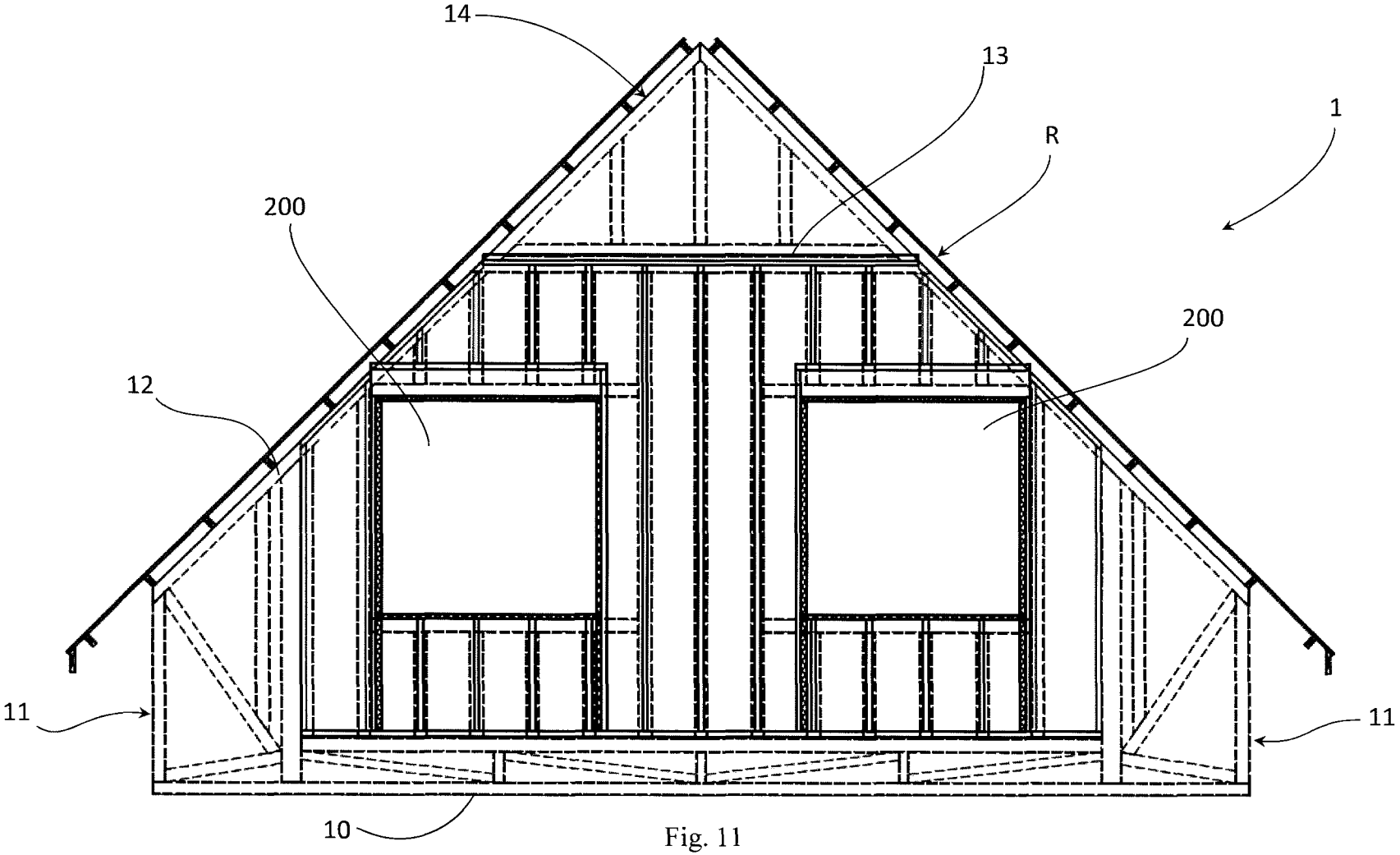
Figure 12:
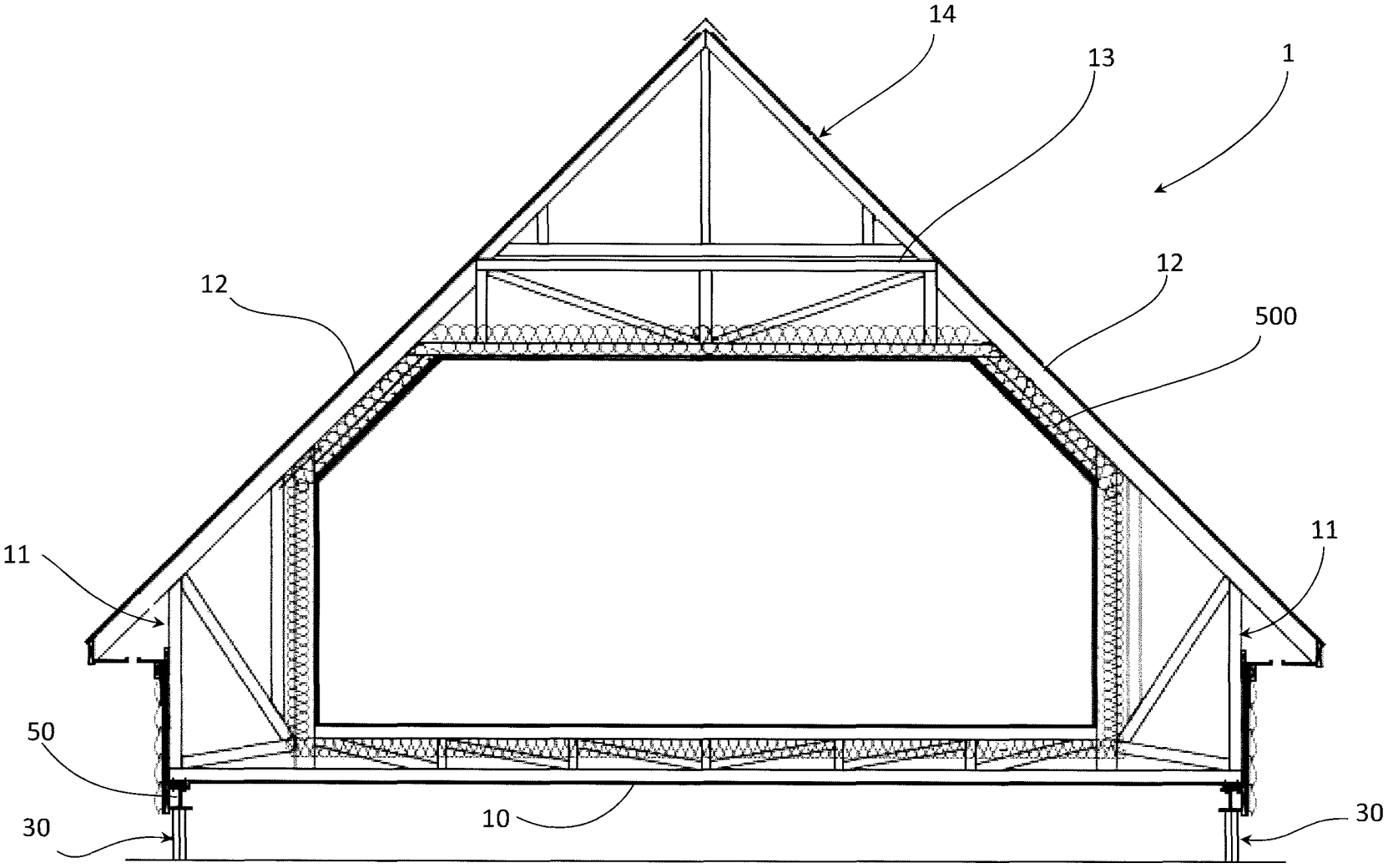
Figure 13:
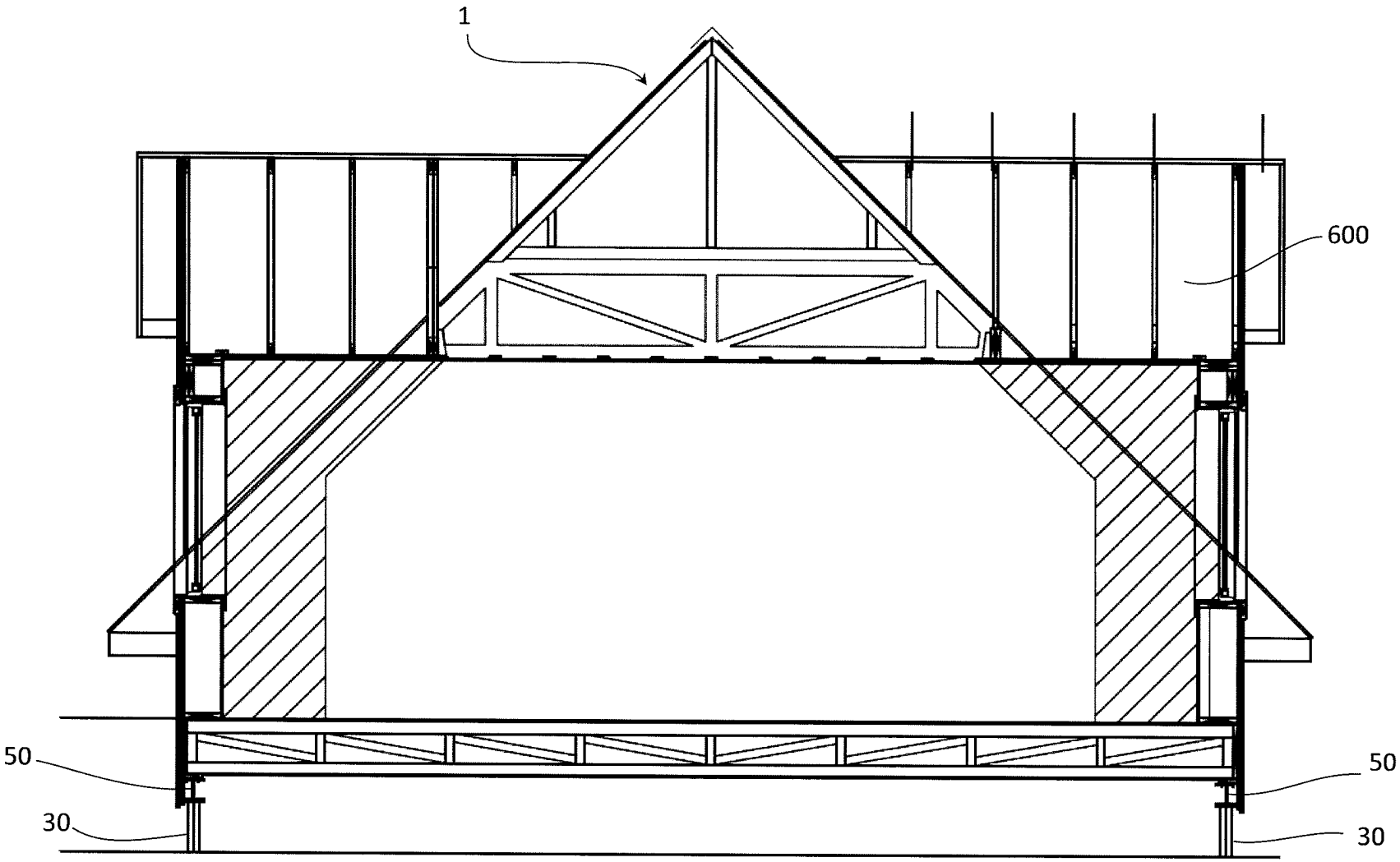
Figure 14:
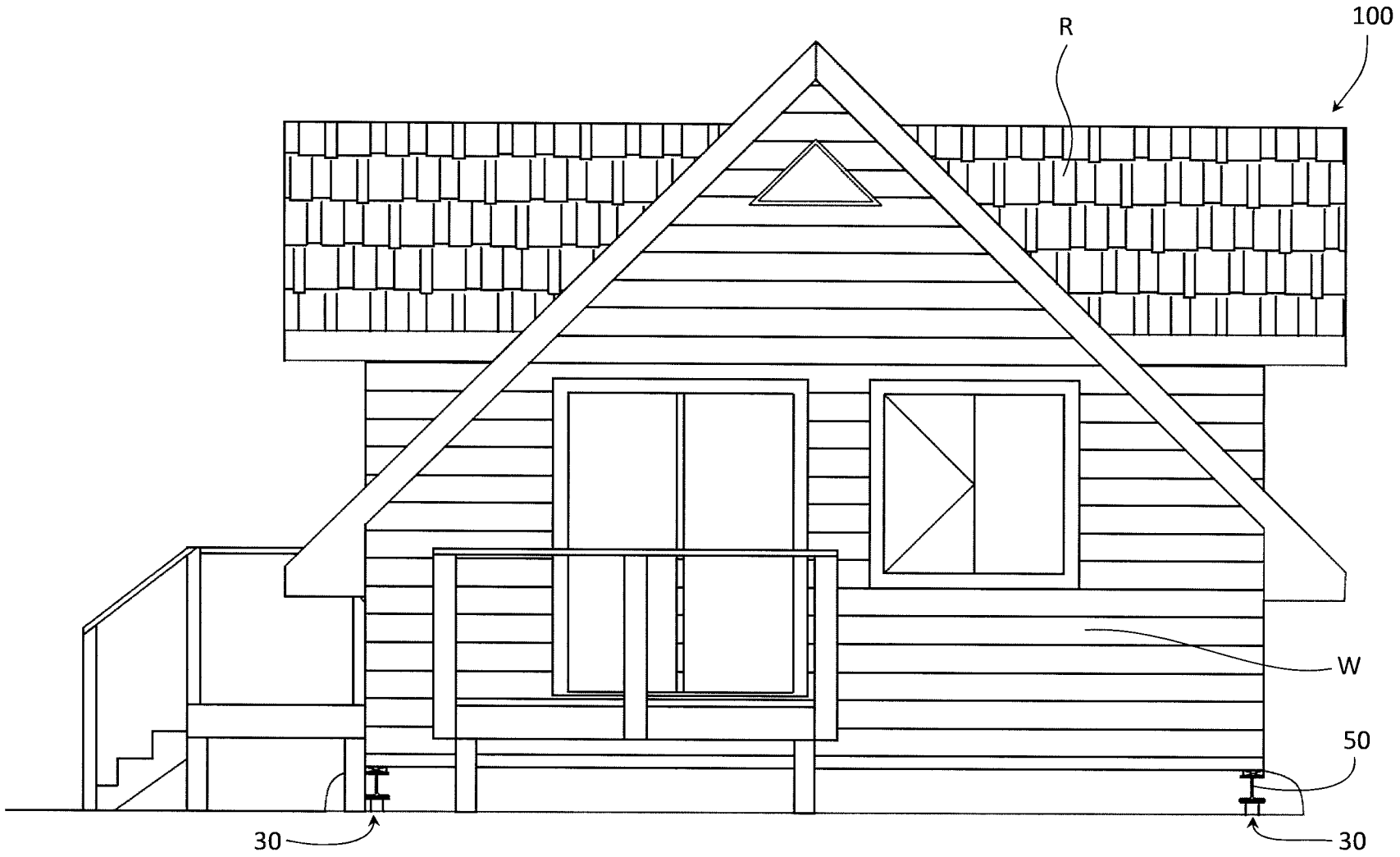
Figure 15:
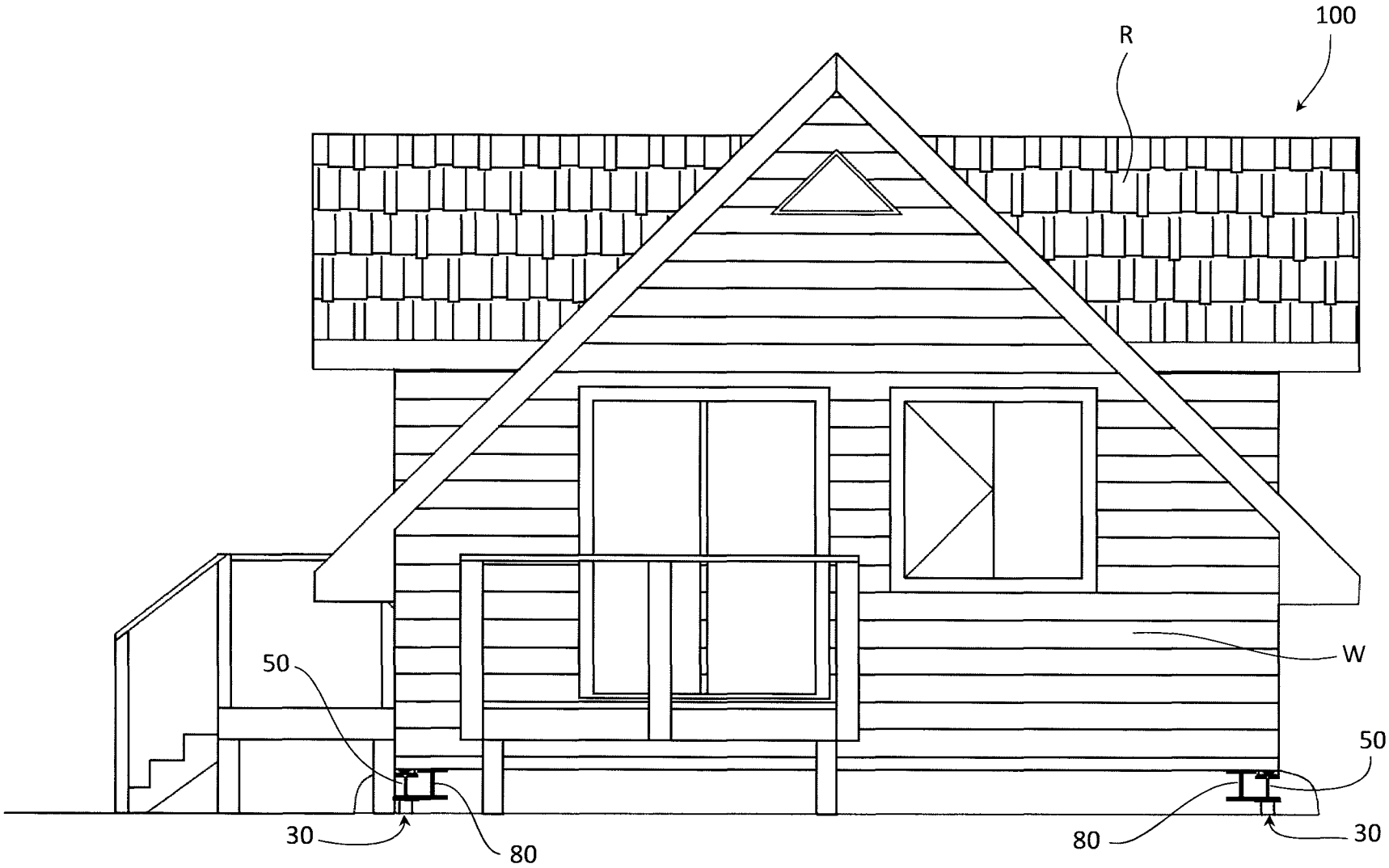
Figure 16:
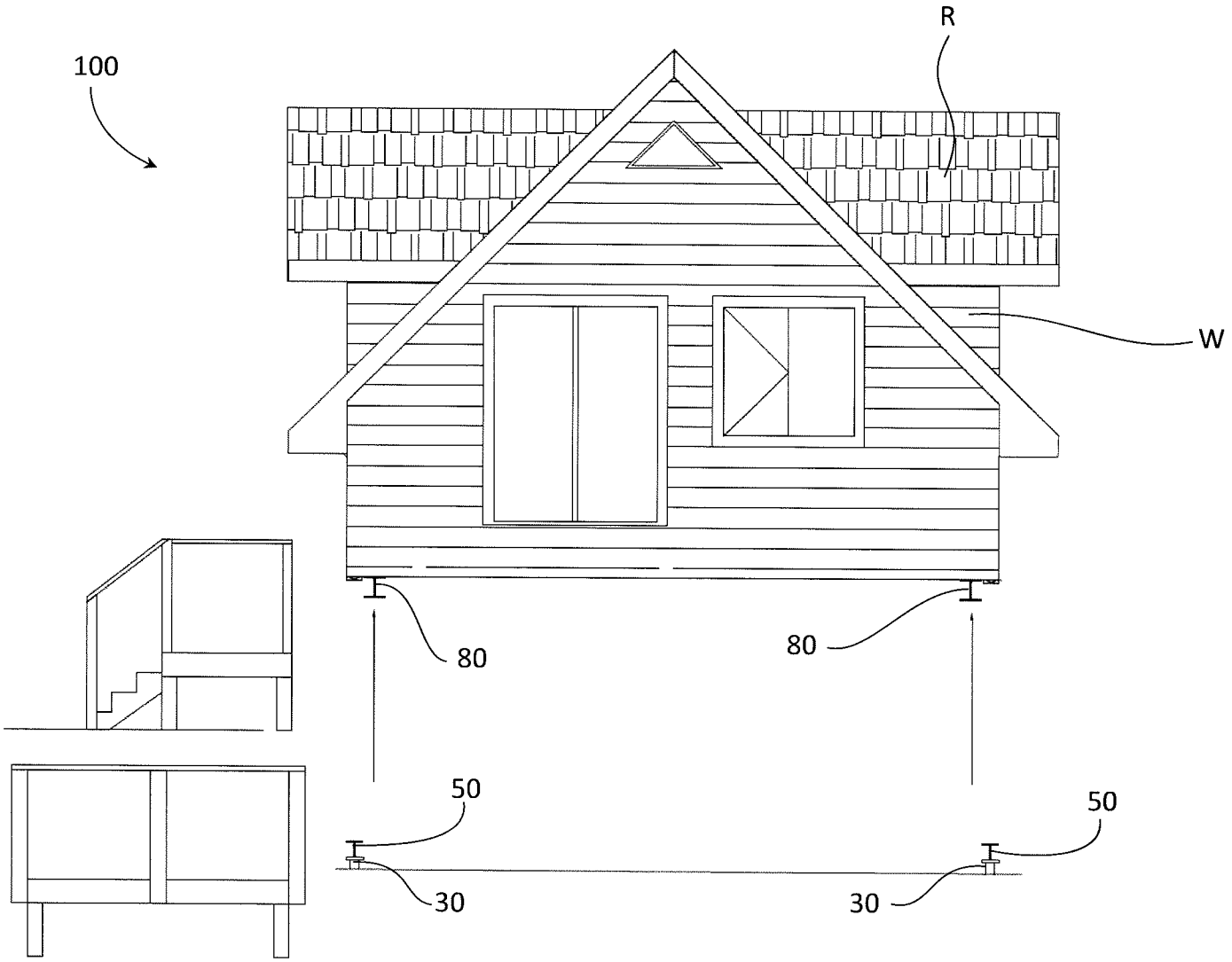
Figure 17:
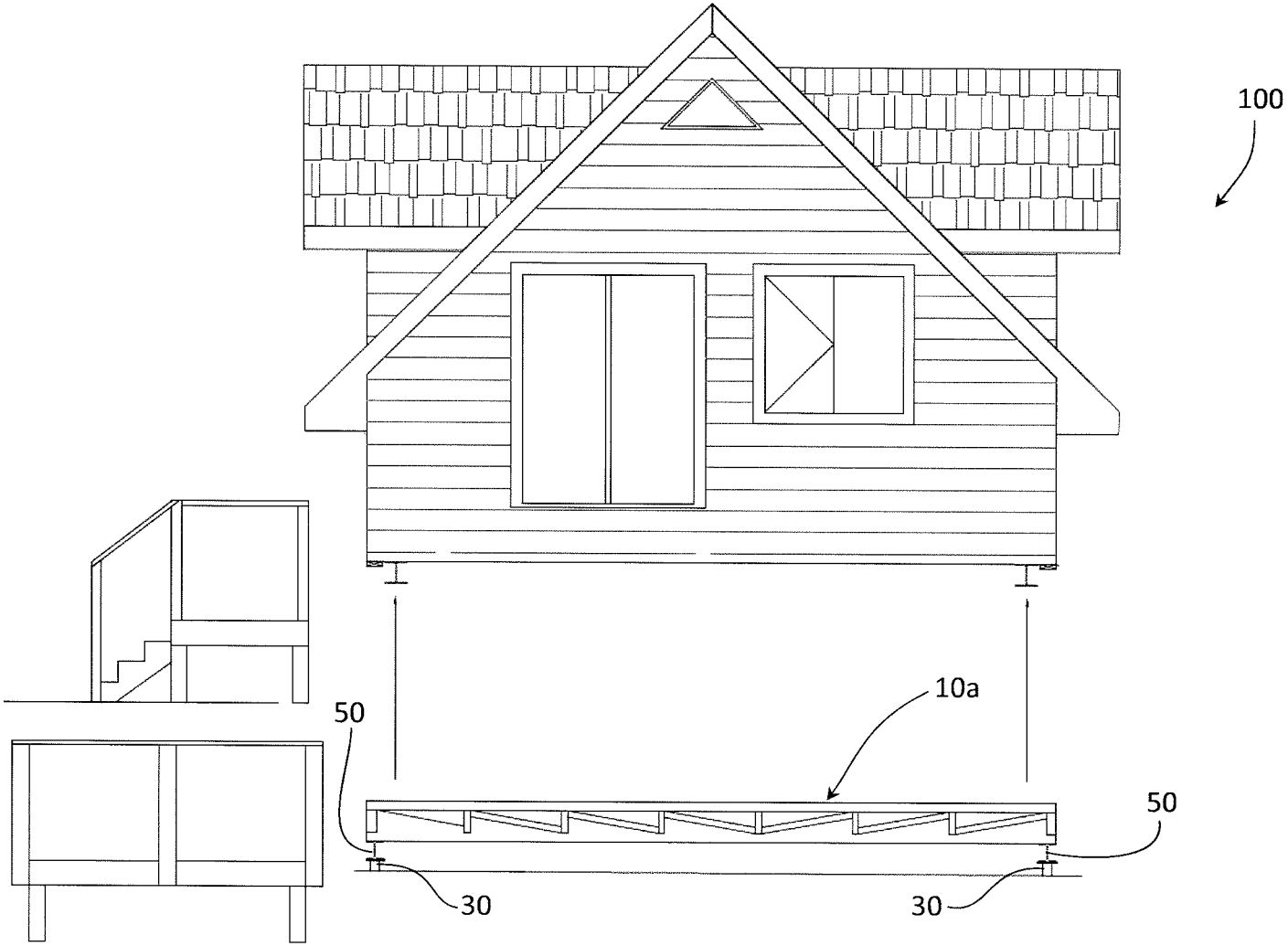
Figure 18:
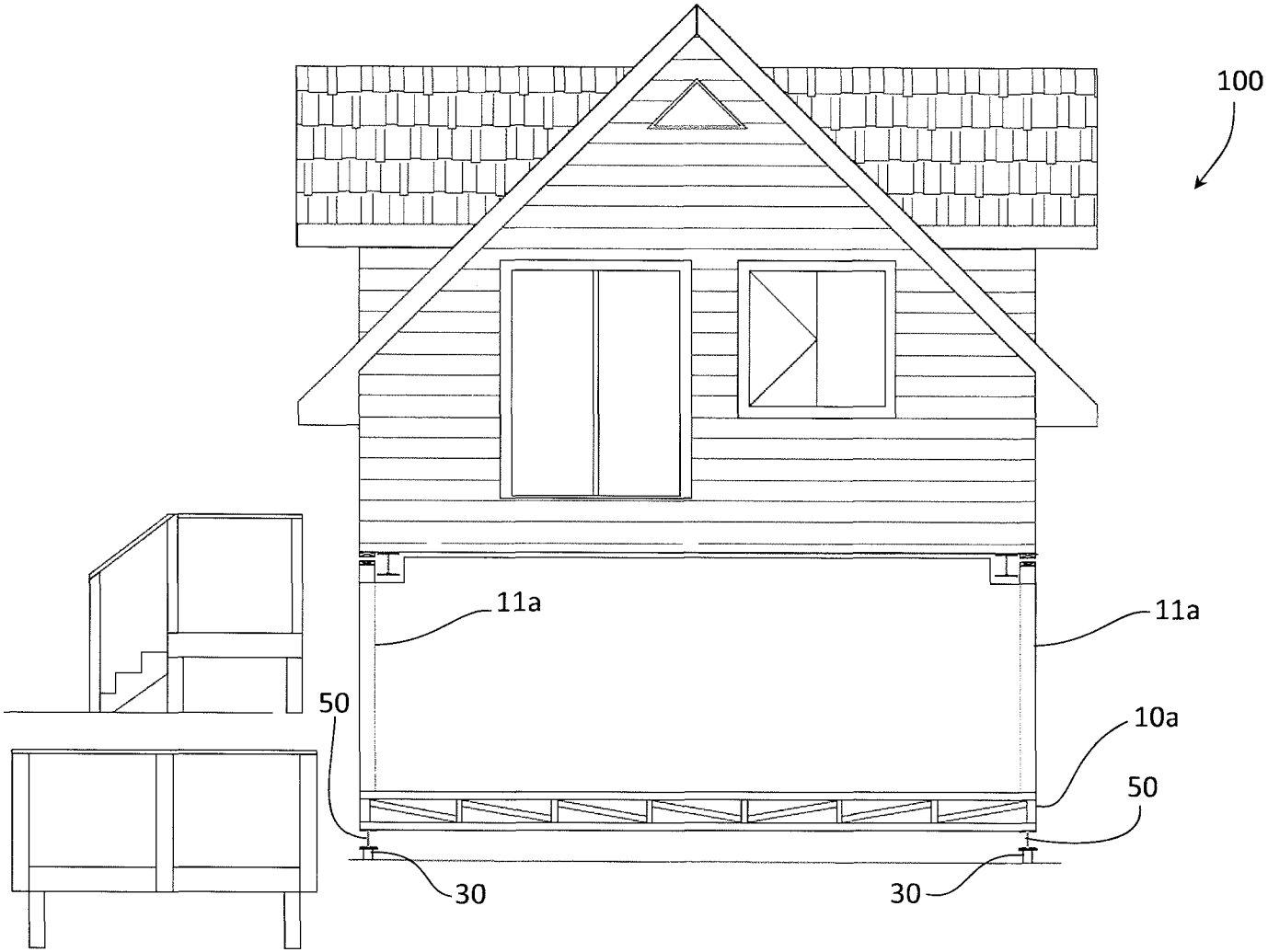
Figure 19:
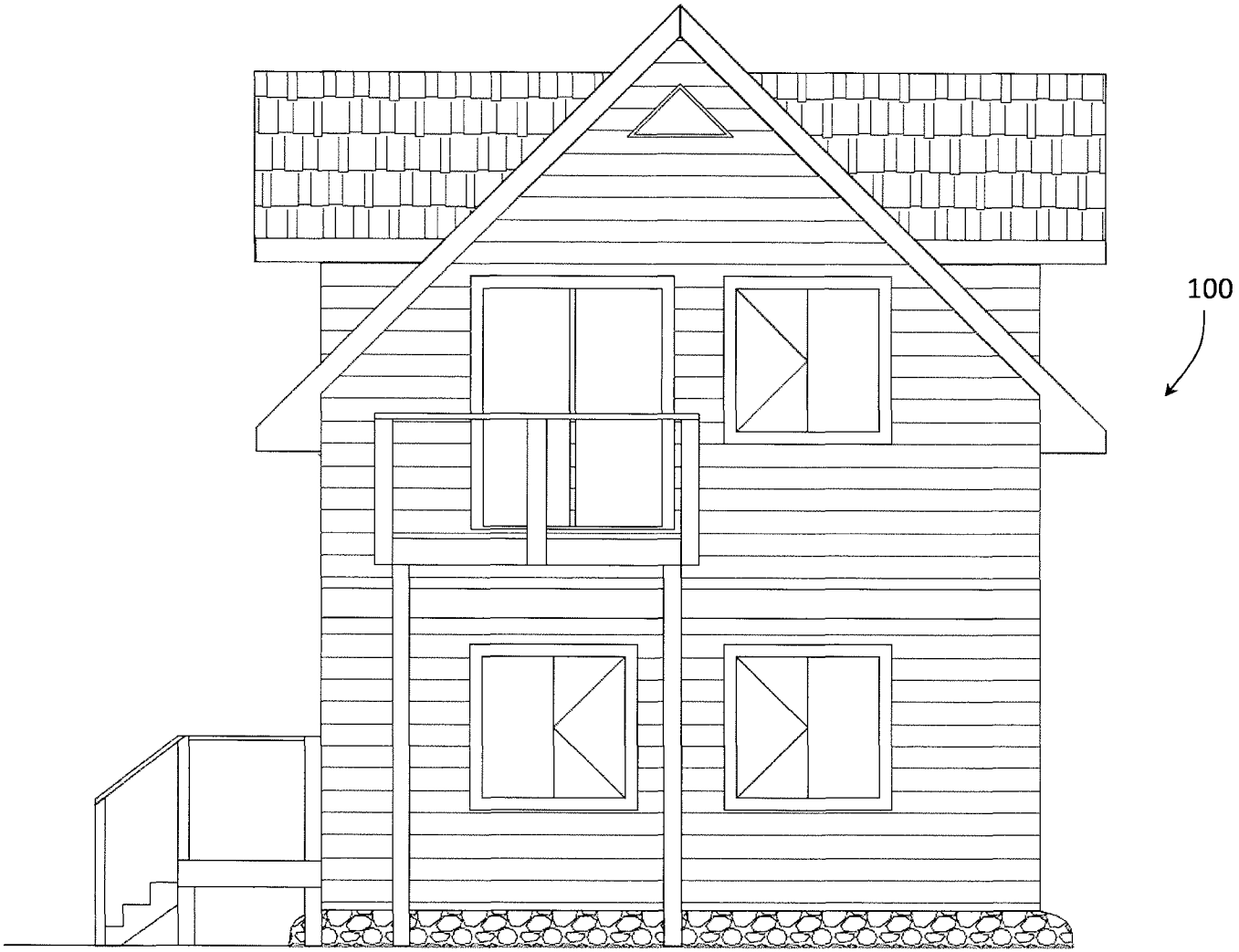

FIGS. 6(*a*) and 6(*b*) are examples of foundation systems, and FIG. 7 is a view showing the foundation system of FIG. 6(*a*) pinned into bedrock or torqued into the ground;

FIGS. 8, 9 and 10 show different side views of a series of building trusses assembled axially apart;

FIG. 11 is an end view, showing window frames;

FIG. 12 is a cross-sectional view of a building truss, with insulation inserted;

FIG. 13 is a cross sectional view of a building at a more advanced stage of construction, with dormers;

FIG. 14 is a side view of the building with foundation beams exposed in preparation for lifting;

FIG. 15 is another side view of the building, with lifting beams inserted under the building;

FIG. 16 is a side view of the building lifted;

FIG. 17 is a side view of the building lifted, with an additional structural floor inserted below for a new ground floor;

FIG. 18 is another side view of the building lifted, with walls assembled for the new ground floor; and FIG. 19 us a side view of the building with lifting complete comprising two storeys.

DESCRIPTION OF THE EMBODIMENTS

Figure 1:
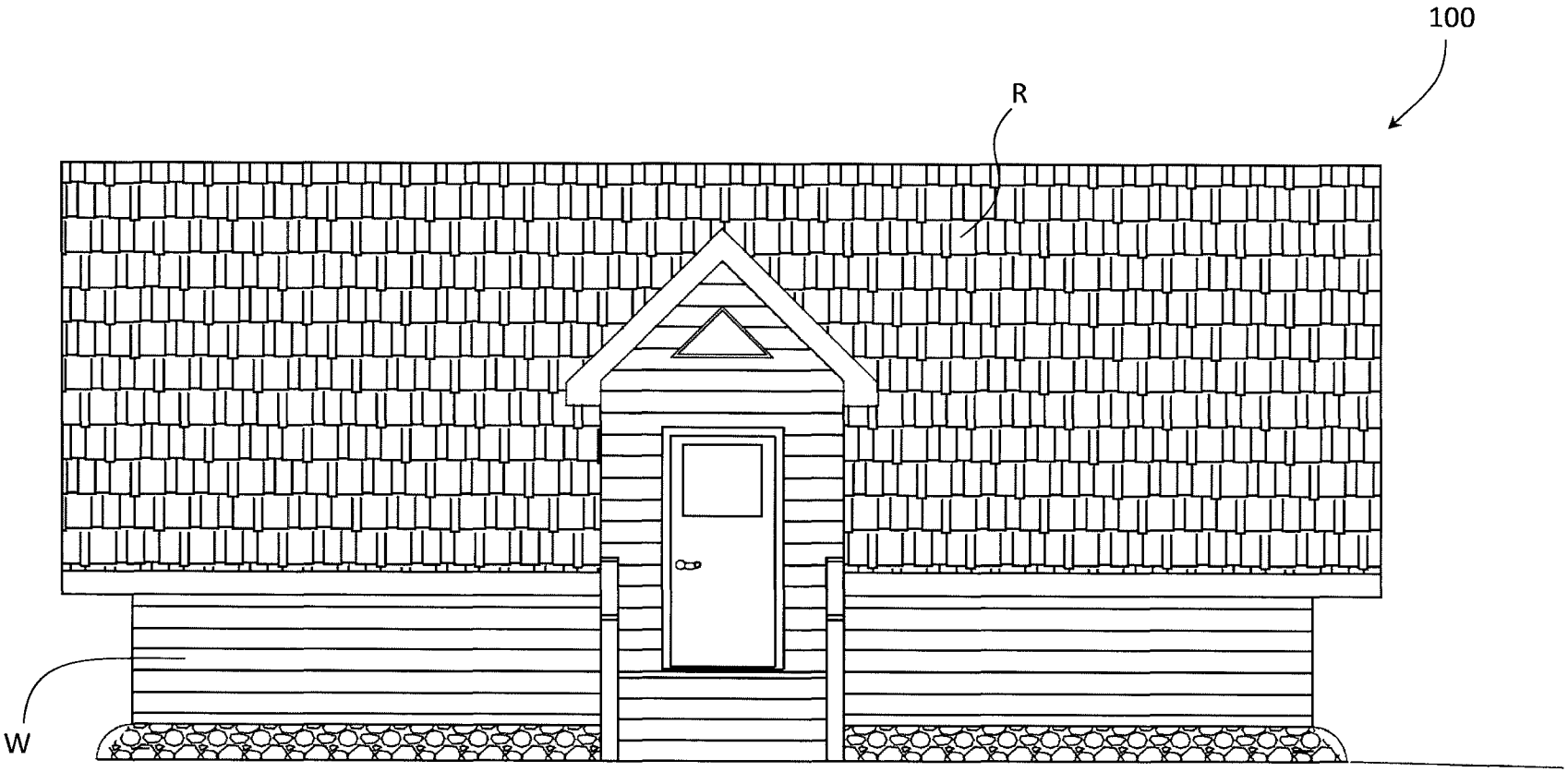
FIGS. 1 and 2 are front and side views of a building incorporating building truss in a system.
Figure 2:
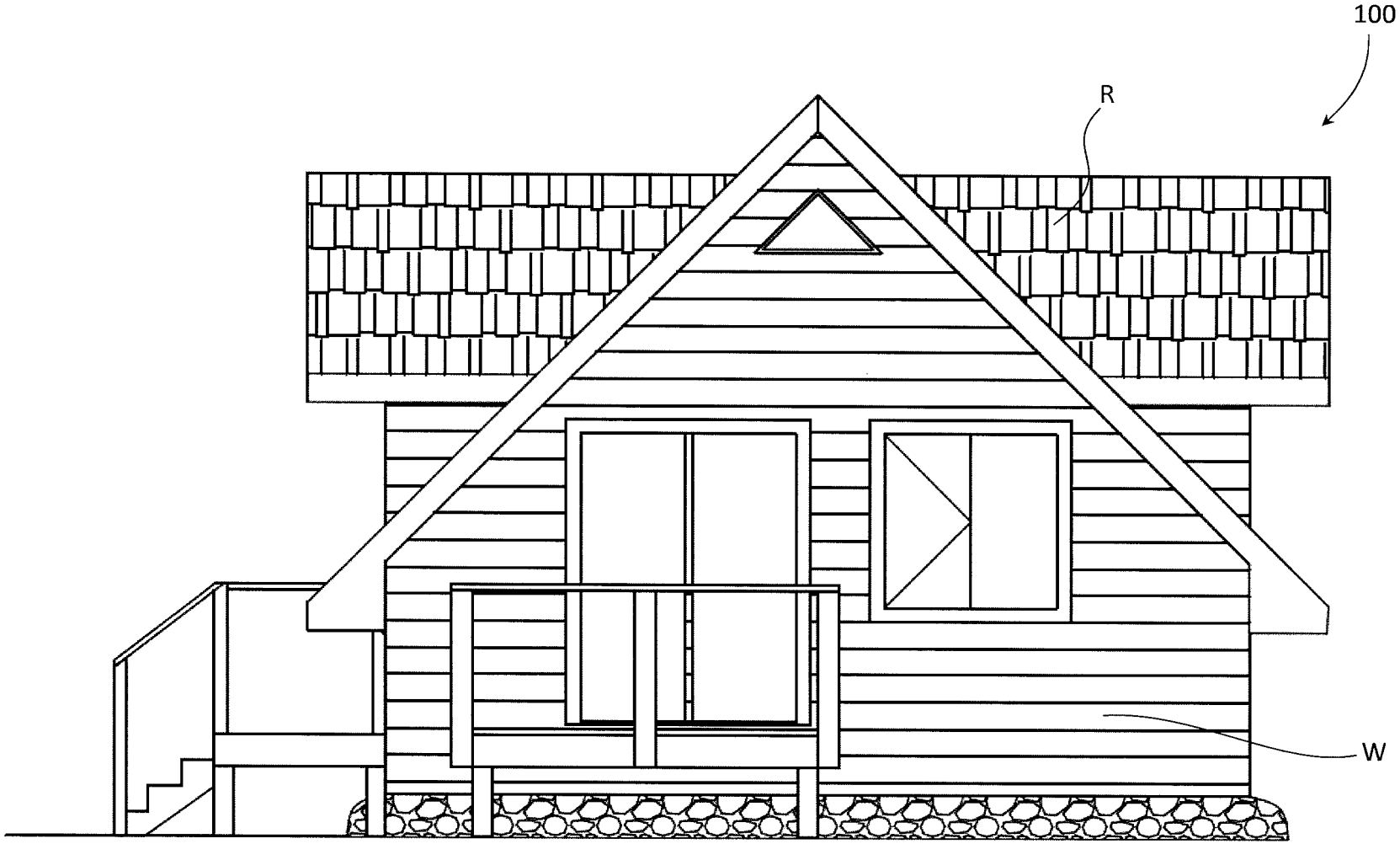

Referring to FIGS. 1 and 2, a building 100 erected by a building truss system is shown. The building is single-storey, wood-framed, and with walls significantly overlapped by a roof and eaves. It is designed and erected in a short period of time using building trusses, as described in detail below.

Figure 3:
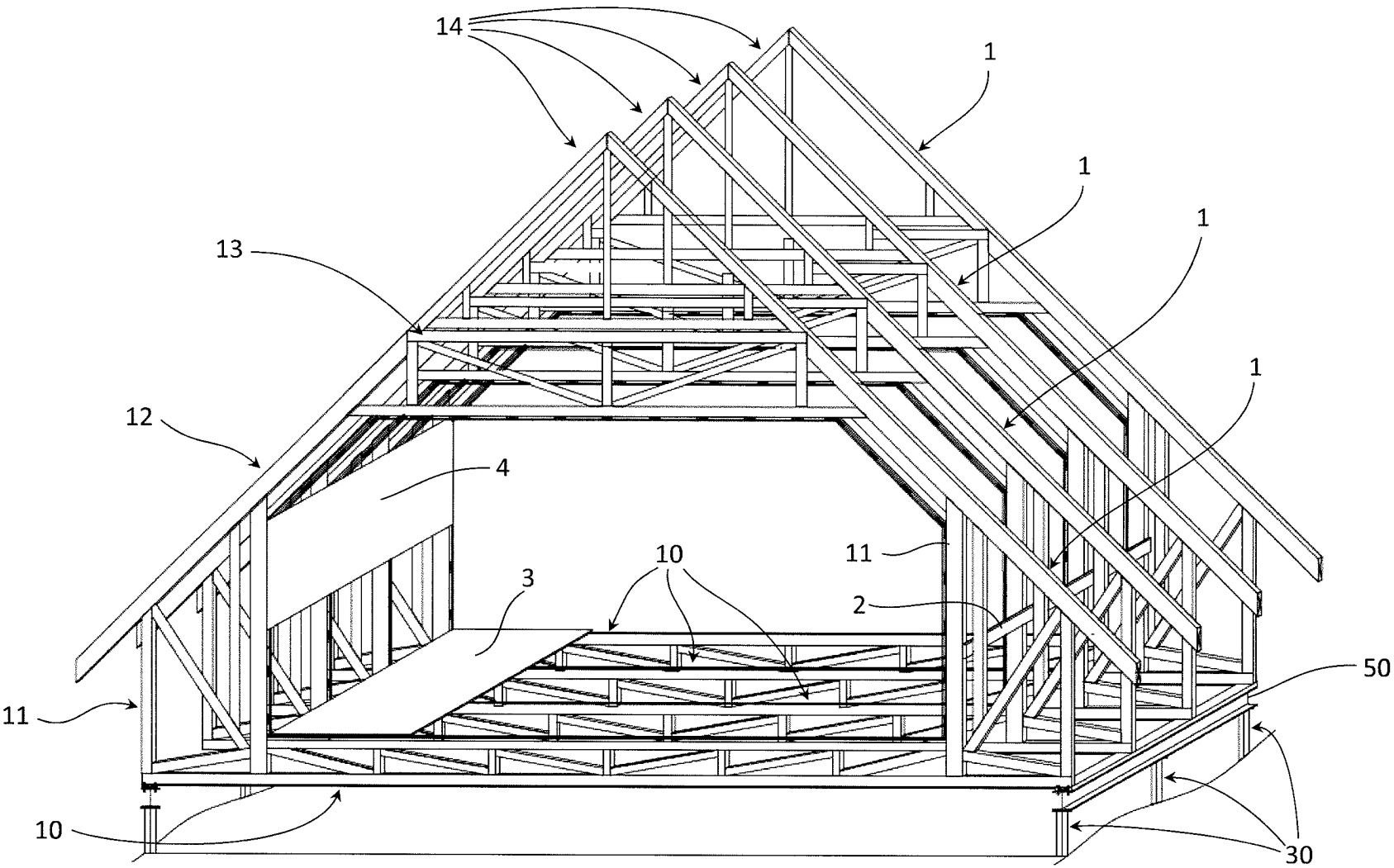
FIG. 3 is a perspective view of a series of building trusses axially spaced apart to form the envelope of a building.
Figure 4:
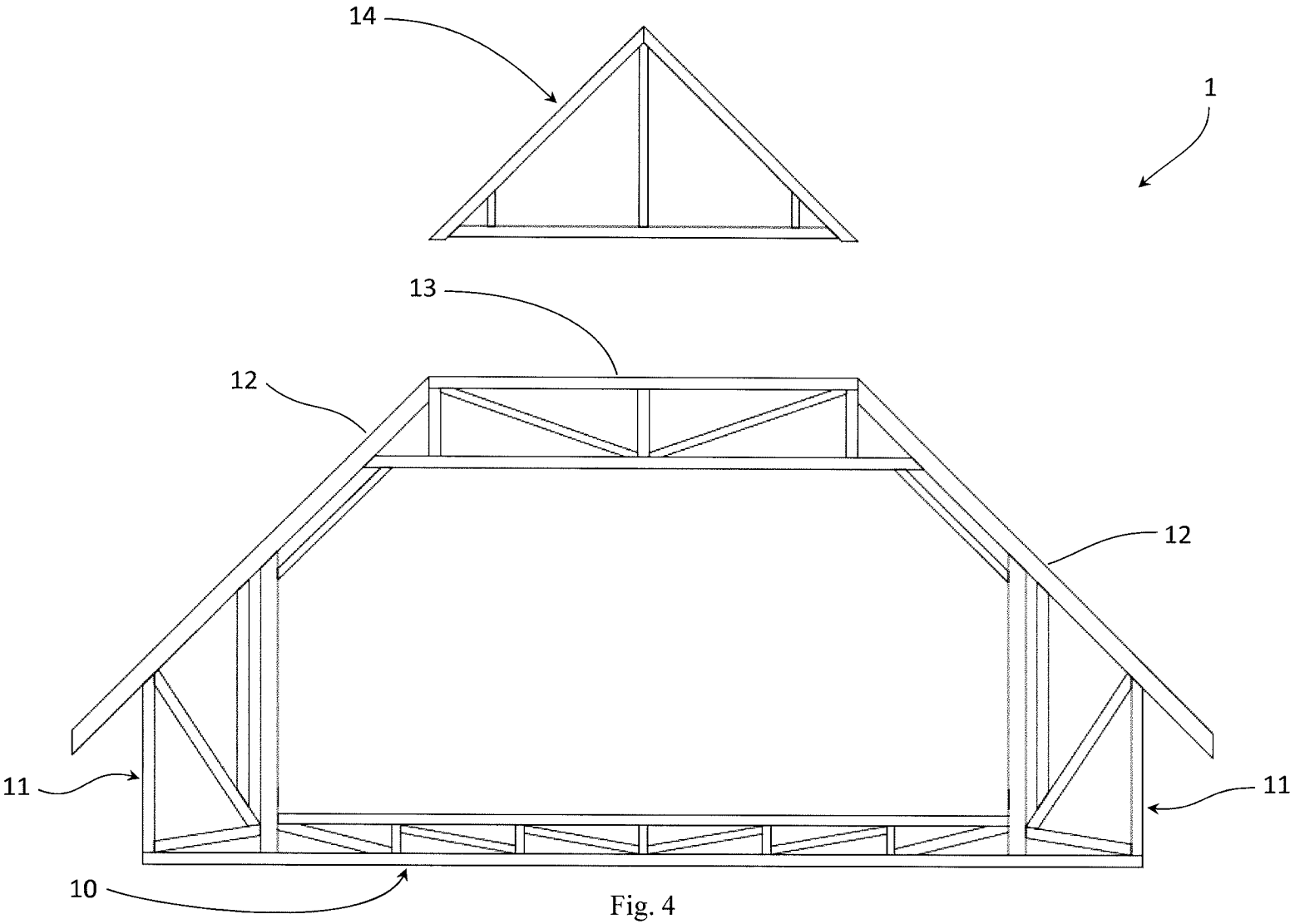
FIG. 4 is an end view of a building truss.

Referring to FIG. 3 the building is constructed by, advantageously, erecting multiple pre-manufactured full building height trusses 1 parallel to each other in sequence in a longitudinal direction spanning one gable end to the opposed gable end. Each building truss includes a structural floor element, a vertical support on each side, rafters, and a lateral horizontal tie, which together define the full room and roof spaces and provide the required structural strength. Each truss 1 also includes a peak truss which provides the building roof apex. Each truss 1 defines a 2D envelope; the floor element spanning in the horizontal direction, vertical supports for the vertical direction and which will be used to form walls, and a roof assembly joining the two vertical supports. The structural floor element spans the width of building's floor plan in the lateral direction, the vertical supports define the wall height in the vertical direction and the truss roof assembly defines the shape of the ceiling. Each pre-fabricated truss is unitary and erecting and interconnecting the multiple trusses parallel to each other on-site provides a 3D structural envelope in the lateral and longitudinal directions (as shown in FIG. 4, for example).

The trusses 1 are linked in the longitudinal direction by horizontal beams 2 extending on each side. Further inter-truss links are provided by floor and wall panels 3 and 4, respectively. These provide the wall and floor surfaces in addition to providing additional structural inter-connectivity.

Each truss 1 has a plane which is referred to in the specification as the lateral plane, in the context of the longitudinal axis or direction being perpendicular to the building truss plane.

The trusses 1 can be prefabricated and manufactured off-site, in existing manufacturing facilities used to produce roof trusses from pre-stress rated lumber thereby benefitting from manufacturing efficiency and accuracy with minimal overhead. On-site construction is very quick as is explained in more detail below.

In more detail, each prefabricated building truss 1 comprises:

10, a structural floor element;

11, a vertical support on each side of the structural floor element;

12, diagonal rafters spanning the vertical supports;

13, a structural horizontal tie which interconnects the rafters; and

14, a roof peak which is mounted on the horizontal tie.

The structural floor elements 10, the vertical structures 11, the rafters 12, and the horizontal ties 13 when assembled together with a number of trusses arranged in the longitudinal direction together form a 3D structural envelope for the building allowing it to require only point foundations and requires only the beams 2 and panels 3 and 4 to achieve the full structural integrity.

Each horizontal structural floor element 10 extends between and is connected to the vertical supports 11 at floor level. The structural floor elements 10 together form a structural floor together with the panels 3, which floor is configured to engage building foundations, which will be described in more detail below.

Figure 5:
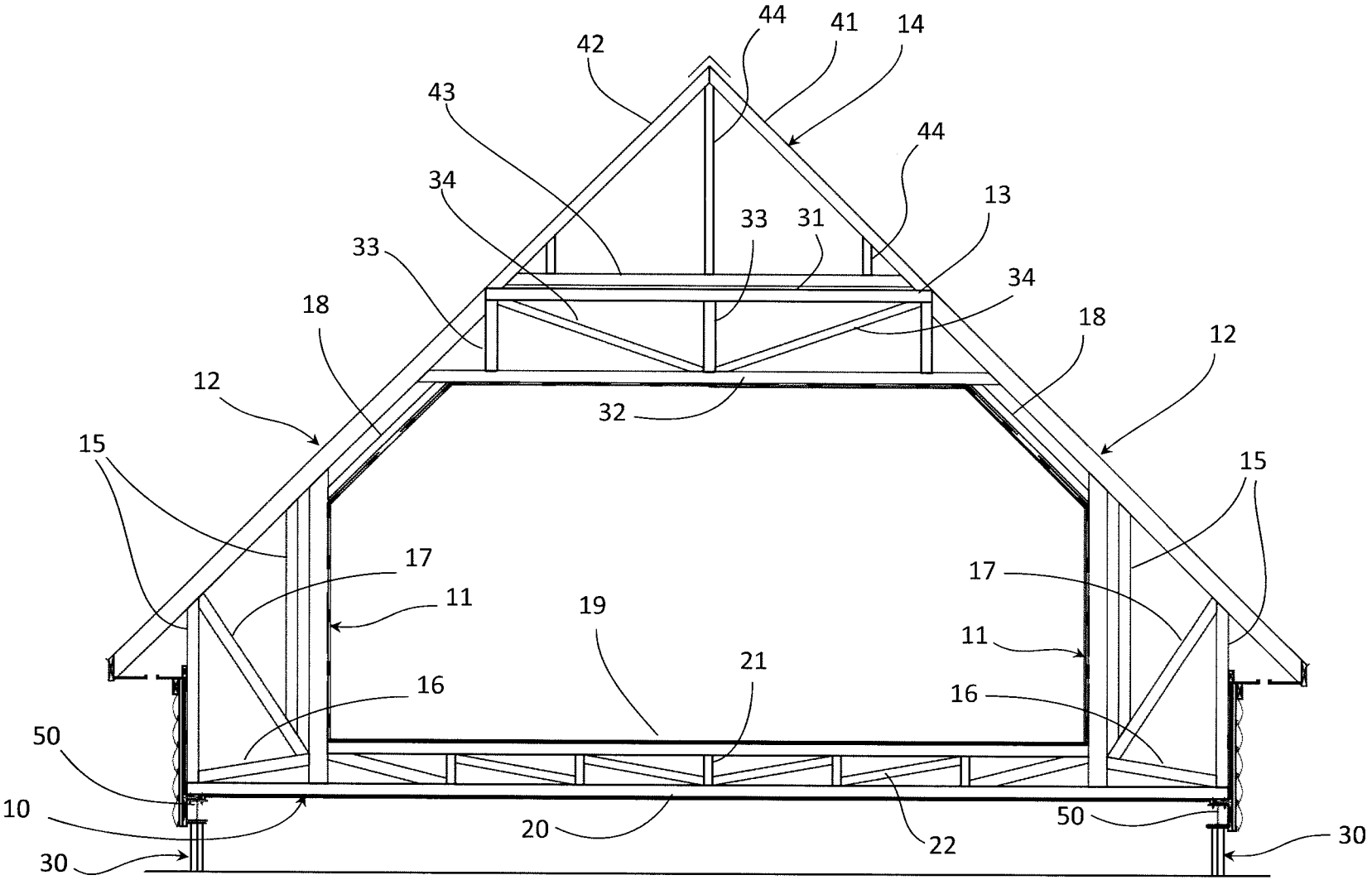
FIG. 5 is another end view of the building truss, with a foundation system.

Referring to FIGS. 4 and 5, the vertical supports 11 each comprise two laterally spaced-apart vertical struts 15 and diagonal braces between the vertical struts 15. A first lower diagonal brace 16 joins the struts 15 at floor level, and an upper diagonal brace 17 joins the struts 15 above the first brace 16.

A pair of rafters 12, together with the horizontal tie 13, span the vertical supports 11. Additional diagonal braces 18 also connect the vertical supports 11 to the tie 13 to provide additional bracing support.

Each truss structural floor element comprises a pair of parallel top and bottom beams 19 and 20 joined by a series of vertical support members 21 and braces 22. A structural floor comprises the truss elements 10 of multiple erected trusses 1, and top floor panels 3 providing a floor surface. In each truss 1 the vertical support first brace 16 is laterally offset of the structural floor element 10, to provide a continuation of structural support with bracing across the truss at floor level and up into the vertical supports.

The horizontal tie 13 and the rafters 12 combine to form a truss roof assembly 25. The truss roof assembly 25 is integrated with the vertical supports 11 by the rafters 12 engaging each vertical strut 15 of the opposed vertical supports 11.

As noted above, the truss floor elements 10, the vertical supports 11, and the truss roof assembly 25 combine to form a 2D structural envelope, which together form the interior space of the building, with the roof truss assembly in particular forming the ceiling envelope and height. When the trusses 1 are combined as shown in in FIG. 3, together with other cladding such as roof tiles and external wall claddings, the full 3D envelope is formed.

Regarding the two vertical struts 15, the outer struts are lower than the inner struts, and the rafter 12 spans the tops of the vertical struts, thereby providing additional bracing strength in the vertical supports and also integrating the roof truss assembly 25 with the vertical supports 11 to form an envelope together with the structural floor element 10. The roof top rafters 3, 4 are joined by the structural horizontal roof tie 13.

The horizontal tie 13 comprises two horizontal members 31 and 32 parallel to each other and spaced apart vertically, with support structure members therebetween. The support structure members comprise a series of uprights 33 and diagonal braces 34. The braces 34 are load-bearing and join the horizontal members 31 and 32.

The horizontal tie 13, with its internal support members provide bracing support between the rafters 12 and the vertical supports 11 to support the roof peak truss 14.

The roof peak trusses 14 form the peak of a house or building, and each comprises two diagonal members 41 and 42, joined together and combined to form an apex, and a horizontal member 43. The peak truss 14 has an internal support structure comprising vertical struts 44. The peak truss 14 is configured to attach to the roof truss assembly horizontal tie 13.

A building system to construct a house or building comprises a number of trusses 1 chosen according to the length in the longitudinal direction, a foundation system, the interconnections beams 2, the floor panels 3 and the wall panels 4. Other items are added according to the design, but these components form the structure of the building.

The foundation system comprises foundation points 30 (shown diagrammatically in FIG. 5) extending from the structural floor element 10. Each foundation point 30 comprises a bearing connected to the structural floor. The foundation system also comprises a foundation beam 50 spanning each foundation point, connecting the floor element 10 to the bearing of the foundation system 30.

Referring to FIG. 6(*a*), a foundation point 30 comprising a steel pile foundation base is shown. A nailer 301 is connected to a house bearing, the nailer 301 being secured to the foundation steel beam 50, connected to a steel base plate 302, which is connected to a steel auger pile 303 pinned to bedrock or torqued into the ground. Advantageously, this allows for the truss to be assembled on a variety of foundations, including rock.

Referring to FIG. 6(*b*), an alternative foundation point 40 comprising a concrete foundation base is shown. A nailer 401 is connected to a structural floor bearing, the nailer 401 being secured to a block wall 402 and a concrete floor footing 403.

FIG. 7 show an example layout for foundation points 30, in this case steel auger piles pinned to bedrock. There are only eight points, four on each lateral side of the building.

To construct a building, in use, the foundation points are formed and a series of trusses 1 are assembled as a system, axially offset from each other to form the length of a building, as shown in FIGS. 8, 9, and 10. The foundation beam 50 spanning each foundation point and the number of foundation points is determined by the bearing capacity of the beam and ground. The beam may be a wood or steel beam, and is continuous, spanning the foundation points 30.

Advantageously, the spacing of the trusses 1 are chosen at design to accommodate openings such as doorways or windows, as shown in FIGS. 9 and 10, with a lintel 61 spanning the opening providing structural support. Once erected, the trusses are interconnected by the truss interconnect beams 2, and at least some of the panels 3 and 4 in the beginning.

An example of a truss 1 at a gable end of a building is shown in FIG. 11, which has been designed and manufactured to accommodate windows 200.

Referring to FIG. 12, a truss 1 with insulation 500 encompassing the internal envelope of the building is shown.

Referring to FIG. 13, dormers 600 can also be assembled between two opposing trusses 1, providing for additional space for additional living, or for windows or doors to be assembled.

Referring to FIG. 14, a constructed building 100 is shown. As can be seen, the floor structure 10 is raised off the ground by the foundation system 30.

In use, the following is an example construction process for a building using the trusses 1.

- the foundation points 30 are installed at spacings predetermined by ground conditions;
- the foundation beam 50 is installed over the foundation points;
- the trusses 1 are shipped flat pack to site;
- the trusses 1 are erected onto the beams 50 in sequence;
- the trusses 1 are fastened together with bracing, as described with the use of the beams 2;
- the trusses 1 are closed in with building outer sheathing materials;
- the trusses 1 are serviced and insulated with ease due to the open frame; and
- the building is finished using conventional methods, the assembled trusses providing space for the electrical and plumbing surfaces, before all of the panels have been attached.

Advantageously, this provides for a quick and efficient assembly of a building. By using the building truss and system of the invention, a building can be assembled in a quick and efficient way.

Every house or building is required to have basic components, such as the roof and floor structure. Advantageously, the truss and system of the invention makes optimum use of these essential components by using the roof to be a significant component forming a building space.

The truss, system, and method achieve and optimum combination of off-site efficient manufacturing, compact transport from the factory because the trusses are planar rather than modular, and there is very efficient erection on site and optimum flexibility for completion of the building to the required design.

Further advantageously, an assembled building can be easily retrofit to provide an extension of space.

Subsequent Extension of the Building

An existing constructed building can advantageously be subsequently modified to retrofit and extend the building, providing an additional storey.

This subsequent modification is achieved by the following series of steps:

- building lifter beams 80 are inserted underneath the building structural floor 10, adjacent to the foundations 30, as shown in FIG. 15;
- the building is lifted as shown in FIG. 16, leaving the existing building foundations 30 in place a new structural floor element 10*a* is installed over the foundation beams 50 and foundation points 30, the beams 50 are pre-engineered at initial design to support a second level;

a new structural floor 10*a* is then assembled on top of the foundations 30, as shown in FIG. 17;

new vertical struts 11*a* are assembled on top of the structural floor 10*a* to form walls. These walls will form the space of the ground floor of the building; and the lifted original building is placed onto the new ground floor walls, with the original structural floor forming a ground floor ceiling structure.

Advantageously, this results in a two-storey building 100*a* as shown in FIG. 19.

Advantages

Further advantageously, the trusses are shipped flat pack to site from the nearest truss manufacturer, an important feature of the design of the truss is that a specific factory is not required and so there is no limit on where the houses or buildings can be built or how many can be produced in a short timeframe.

Further advantageously, the trusses may be manufactured using machine stress rated lumber (as described here: https://www.nrcan.gc.ca/forests/industry/products-applications/15833), allowing multiple grades of lumber to be utilized. In a conventional house structural select or high-grade lumber only is used. The use of machine stress rated lumber significantly reduces wastage and cost.

Further advantageously, truss plating of machine stress rated lumber means each truss is engineered and no engineered design is required for the housing system. Trusses can be shipped all over the world in response to such events as natural disaster, forest fire damage etc, immediately forming engineered housing.

Further advantageously, the natural open web nature of the truss allows for ease of continuous insulation for excellent thermal insulation and envelope U-values.

Further advantageously, the system provides for a large roof area, and this provides space for a platform for solar power and rain water collection.

Further advantageously, the system allows for all interior walls to be non-load bearing resulting in quick and efficient construction of houses and so provides for more accessible housing.

Further advantageously, the subsequent modification of a building to provide an additional storey is very cost efficient. This is because the fundamental structure of the building, the roof and foundation, are already existing. The lift and build of an additional lower level costs approximately half of the original structure. The full span of the truss floor allows the new lower level to be built without interior load bearing walls, so again provides for more accessible housing.

Further advantageously, the truss can be used with any conventional foundation system, depending on what system is best suited to the terrain. For example, the use of a concrete foundation allows for a regular foundation, the steel foundation allows for use on almost any terrain.

Further advantageously, the use of the truss with a steel foundation system means that land that was previously unusable or less desirable for building houses, is now accessible.

The invention is not limited to the embodiments described but may be varied in construction and detail.

The invention claimed is:

1. A method of constructing a building including the steps of:

(a) providing a prefabricated building truss comprising:

i. a roof truss assembly including at least one rafter and at least one joist;

ii. at least two opposed building room-height vertical supports which are bridged by the roof truss assembly at roof level; and iii. a horizontal structural floor element extending between and connected to the vertical supports at floor level, the structural floor element being configured to engage a building foundation system;

(b) providing the foundation system at ground level;

(c) mounting a plurality of the prefabricated building trusses in parallel and spaced apart in the longitudinal direction;

(d) linking the plurality of prefabricated building trusses by interconnect beams to form a structural floor which engages the foundation system;

(e) applying panels to form at least internal wall, floor and ceiling surfaces; and (f) providing utility services and performing finishing tasks, wherein the roof truss assembly is integrated with the vertical supports by a rafter engaging at least one vertical strut of each opposed vertical support; and wherein each vertical support comprises at least two vertical struts in which outer struts are lower in height than inner struts, and the roof truss assembly rafters span the vertical support struts, thereby providing additional bracing strength to the vertical supports and also integrating the roof truss assembly with the vertical supports to form an envelope together with the structural floor; and wherein the roof truss assembly comprises a structural horizontal roof tie which comprises the at least one joist, and interconnects opposed rafters of the roof truss assembly, and said rafters are connected to the vertical supports; and wherein the roof truss assembly comprises at least one brace, parallel to a rafter, and connecting a vertical support to the horizontal tie; and wherein the horizontal tie comprises at least two parallel horizontal tie members and a support structure between the horizontal tie members; and wherein the horizontal tie support structure comprises a plurality of load-bearing braces joining the horizontal tie members.

2. The method as claimed in claim 1, wherein the trusses are connected to the foundation system by a foundation beam spanning a plurality of foundation points.

3. The method as claimed in claim 1, wherein the trusses are connected to the foundation system by a foundation beam spanning a plurality of foundation points; and wherein the trusses are erected on the foundation beams in sequence.

4. The method as claimed in claim 1, wherein at least one vertical support comprises a plurality of laterally spaced-apart vertical struts, and at least one diagonal brace between the vertical struts.

5. The method as claimed in claim 1, wherein at least one vertical support comprises a plurality of laterally spaced-apart vertical struts, and at least one diagonal brace between the vertical struts; and wherein a lower first diagonal brace joins the struts at floor level, and at least one upper diagonal brace joins the struts above the first brace.

6. The method as claimed in claim 1, wherein at least one vertical support comprises a plurality of laterally spaced-apart vertical struts, and at least one diagonal brace between the vertical struts; and wherein a lower first diagonal brace joins the struts at floor level, and at least one upper diagonal brace joins the struts above the first brace; and wherein the structural floor element comprises a top beam, a bottom beam, and internal support structural members between said beams.

7. The method as claimed in claim 1, wherein at least one vertical support comprises a plurality of laterally spaced-apart vertical struts, and at least one diagonal brace between the vertical struts; and wherein a lower first diagonal brace joins the struts at floor level, and at least one upper diagonal brace joins the struts above the first brace; and wherein the structural floor element comprises a top beam, a bottom beam, and internal support structural members between said beams; and wherein the floor structural members comprise a series of uprights and diagonal braces; and wherein the vertical support first diagonal brace is laterally offset of the structural floor element, providing a continuation of bracing support across the truss at floor level.

8. The method as claimed in claim 1, wherein the truss comprises a peak roof truss, which is attachable to underlying components of the roof truss assembly, said peak truss and the rafters adapted to combine to form an apex roof structure.

9. The method as claimed in claim 1, wherein the roof truss assembly comprises a structural horizontal roof tie which comprises the at least one joist, and interconnects opposed rafters of the roof truss assembly, and wherein a peak truss is attachable to the horizontal tie.

10. The method as claimed in claim 1, wherein the foundation system comprises a plurality of foundation points extending from the structural floor; wherein the foundation system comprises a foundation beam spanning a plurality of the foundation points; and wherein each foundation point comprises a bearing for connection to the foundation beam, at a first end of the bearing.

11. The method as claimed in claim 1, wherein the foundation system comprises a plurality of foundation points extending from the structural floor; wherein the foundation system comprises a foundation beam spanning a plurality of the foundation points; and wherein each foundation point comprises a bearing for connection to the foundation beam, at a first end of the bearing; and wherein the bearing is adapted to be connected at a second end to a nailer, which is connected to a steel base plate, which is connected to a steel auger plate, the auger plate configured to be pinned or torqued into bedrock.

12. The method as claimed in claim 1, wherein the foundation system comprises a plurality of foundation points extending from the structural floor; wherein the foundation system comprises a foundation beam spanning a plurality of the foundation points; and wherein each foundation point comprises a bearing for connection to the foundation beam, at a first end of the bearing; and wherein the bearing is adapted to be connected at a second end to a nailer, which is connected to a steel base plate, which is connected to a steel auger plate, the auger plate configured to be pinned or torqued into bedrock; and in which the building trusses are erected parallel to each other in series in the longitudinal direction, are joined by the interconnect beams and the panels in the longitudinal direction, and the structural floor elements combine to form a structural floor mounted on the foundation system.

* * * * *